US006511213B1

(12) United States Patent
Maley, Sr.

(10) Patent No.: US 6,511,213 B1
(45) Date of Patent: Jan. 28, 2003

(54) LIGHTING FIXTURE LENS RETAINER

(75) Inventor: William B. Maley, Sr., Orange, CT (US)

(73) Assignee: Techlite Inc., Milford, CT (US)

( * ) Notice: Subject to any disclaimer, the term of this patent is extended or adjusted under 35 U.S.C. 154(b) by 0 days.

(21) Appl. No.: 09/969,914

(22) Filed: Oct. 3, 2001

Related U.S. Application Data

(63) Continuation-in-part of application No. 09/721,486, filed on Nov. 14, 2000, now abandoned.

(51) Int. Cl.[7] ..... F21V 21/00

(52) U.S. Cl. ..... 362/374; 362/375; 362/455; 362/223

(58) Field of Search ..... 362/223, 224, 362/374, 375, 455

(56) References Cited

U.S. PATENT DOCUMENTS 4,410,931 A * 10/1983 DeCandia et al. ..... 362/223
4,868,727 A * 9/1989 Ponds et al. ..... 362/223
5,653,532 A * 8/1997 Chan ..... 362/295
5,716,123 A * 2/1998 Lamming ..... 362/222
5,906,427 A * 5/1999 Noh ..... 362/219
6,152,573 A * 11/2000 Mitchell ..... 362/217

* cited by examiner

*Primary Examiner*—Sandra O'Shea
*Assistant Examiner*—Hargobind S. Sawhney
(74) *Attorney, Agent, or Firm*—John H. Crozier

(57) ABSTRACT

In a preferred embodiment, a lighting fixture lens retainer for a lighting fixture of the type having a generally horizontally extending first lens held in upper and lower fixture members by insertion of first and second mounting flanges formed, respectively, along upper and lower edges of the first lens inserted into first and second mounting grooves formed, respectively, along the upper and lower fixture members, the lighting fixture lens retainer comprising: a retaining member being disposed within the lighting fixture and being movable between a first, open position in which the retaining member is spaced apart from an inner surface of the first lens and a second, securing position in which the retaining member bears against the inner surface of the lens in such manner as to secure the first mounting flange in the first mounting groove.

8 Claims, 8 Drawing Sheets

LIGHTING FIXTURE LENS RETAINER

CROSS-REFERENCE TO RELATED APPLICATION

The present application is a continuation-in-part of co-pending U.S. patent application Ser. No. 09/721,486, filed Nov. 24, 2000, and titled LIGHTING FIXTURE LENS RETAINER, now abandoned.

BACKGROUND OF THE INVENTION

1. Field of the Invention

The present invention relates to lighting fixtures generally and, more particularly, but not by way of limitation, to a novel lens retainer for lighting fixtures.

2. Background Art

Lighting fixtures take many forms, the one primarily under consideration here is the horizontally elongated lighting fixture typically found on railroad cars, for example; although, the present invention may be employed in any similar lighting fixture in any application, The horizontally elongated lighting fixture includes upper and lower members each having a horizontally elongated groove into which mounting flanges of corresponding horizontally elongated translucent lenses are inserted. The mounting flanges are inserted into the grooves by means of plastically deforming, the lenses and snapping the mounting flanges into the grooves. The mounting flanges and, thus the lenses, are held in place by the spring action of the plastically deformable lenses. A narrow metallic band covers the joint between adjacent lenses, the band having flanges formed at either end thereof. In order to install the band, the upper and lower edges of the ends of the lenses are sequentially pressed inwardly and the flanges are slid into the grooves. Upon release, the lenses return to their normal, installed state and hold the band in place.

While, in normal circumstances, such a mounting arrangement is satisfactory, in the case of a accident when the lighting fixtures are used in railroad cars, for example, or in the case where a person bumps against a lighting fixture lens, the lens may become dislodged from its mounting and the falling lens can cause injury to persons or property.

Screws, for example, could be inserted through, say, the upper metallic member into the lens to secure the lens in place. However, such attachments would detract from the generally clean aesthetic appearance of the lighting fixtures and increase the opportunity for vandalism or breaking of the lense.

Accordingly, it is a principal object of the present invention to provide means for securing in place lighting fixture lenses of the type described above.

It is a further object of the present invention to provide such means that is rot clearly visible from the exterior of the lighting fixture as to the method of lens removal.

It is an additional object of the present invention to provide such means that can be easily employed.

It is another object of the present invention to provide such means that can be economically manufactured, It is yet a further object of the invention to provide such means that can he easily released for removal of the lighting fixture lens.

It is yet an additional object of the invention to provide a means where the lens is secured by pressure on the lens from inside the lighting fixture, Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a lighting fixture lens retainer for a lighting fixture of the type having a generally horizontally extending first lens held in upper and lower fixture members by insertion of first and second mounting flanges formed, respectively, along upper and lower edges of said first lens inserted into first and second mounting grooves formed, respectively, along said upper and lower fixture members, said lighting fixture lens retainer comprising: a retaining member being disposed within said lighting fixture and being movable between a first, open position in which said retaining member is spaced apart from an inner surface of said first lens and a second, securing position in which said retaining member bears against said inner surface of said lens in such manner as to secure said first mounting flange in said first mounting groove.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
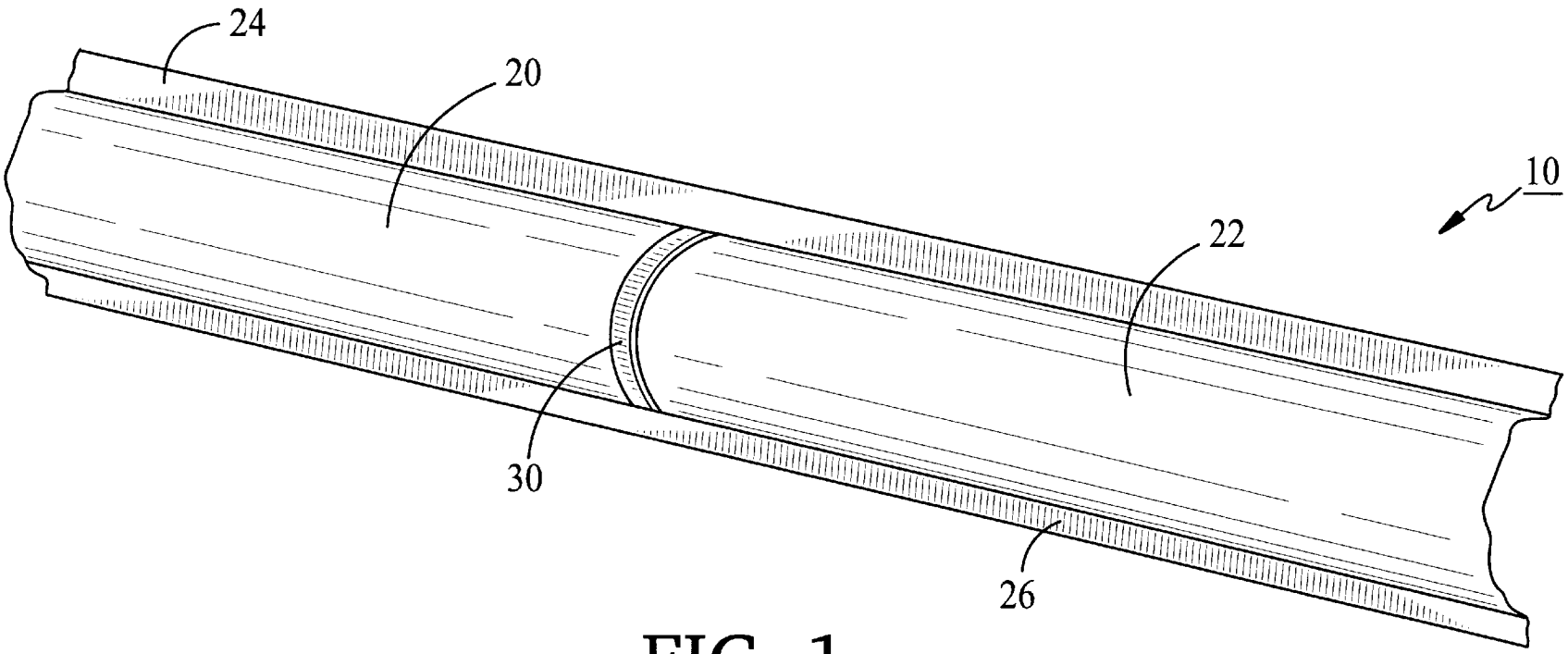
FIG. 1 is a fragmentary isometric view of a lighting fixture in which the present invention can be employed.

Reference should now be made to the drawing figures, on which similar or identical elements are given consistent identifying numerals throughout the various figures thereof, and on which Parenthetical references to figure numbers direct the reader to the view(s) on which the element(s) being described is (are) best seen, although the element(s) may be seen also on other views.

Referring now to FIG. 1, there is illustrated a lighting fixture of the type with which the present invention can be used, the lighting fixture being indicated generally by the reference numeral 10. Lighting fixture 10 includes two translucent horizontally elongated lenses 20 and 22 having mounting flanges formed at the edges thereof inserted into mounting grooves of the upper and lower fixture members, herein after referred to as upper and lower extrusions, 24 and 26, respectively; the mounting grooves, the mounting flanges, and the upper and lower extrusions not being shown on FIG. 1. Lenses 20 and 22 are separated by a small gap that is covered by metallic band 30 also having its ends inserted into the mounting grooves.

Figure 2A:
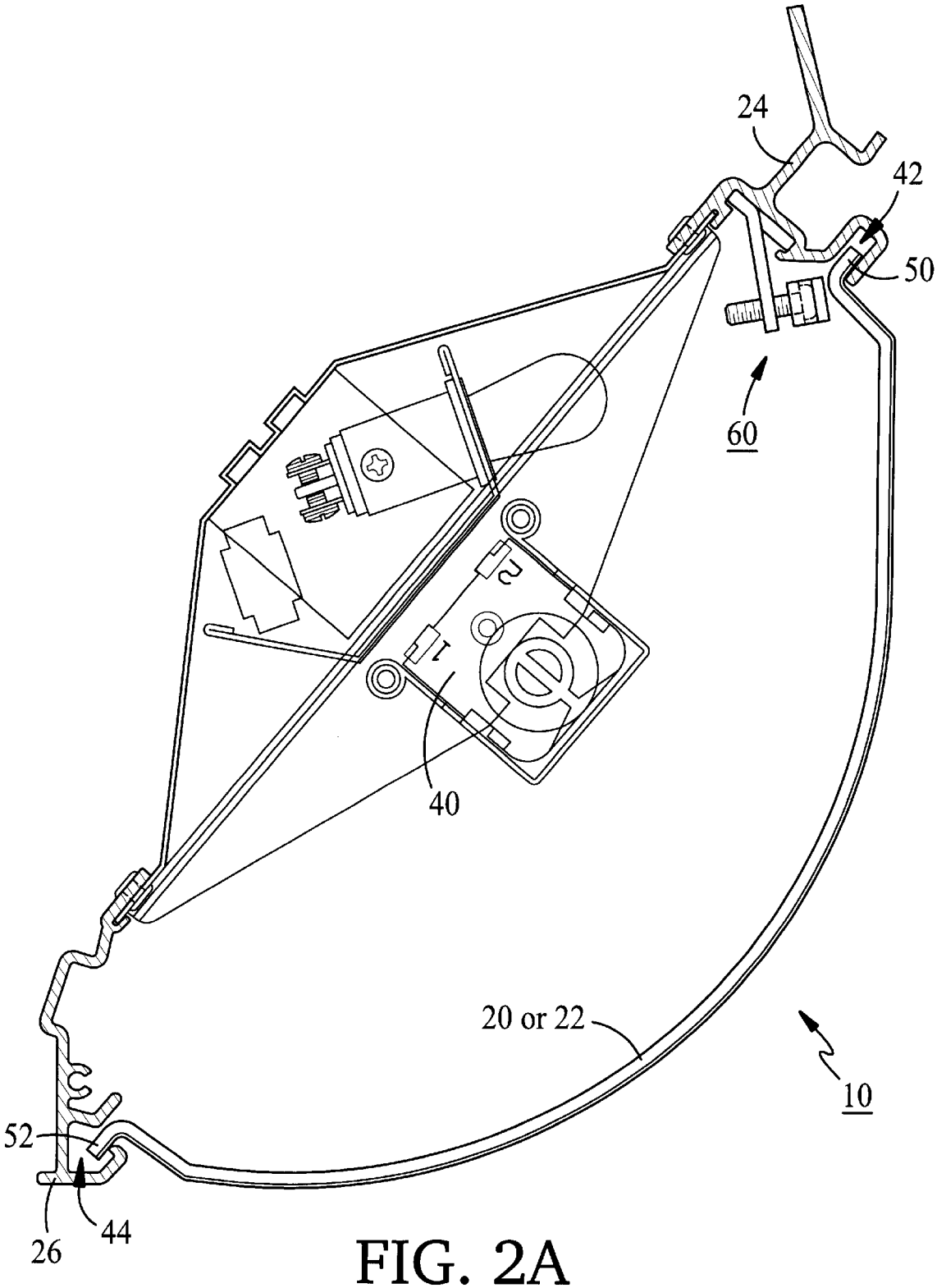
FIG. 2A is an end elevational view, partially in cross-section, of the lighting fixture, showing one embodiment of the lens retainer of the present invention.
Figure 2B:
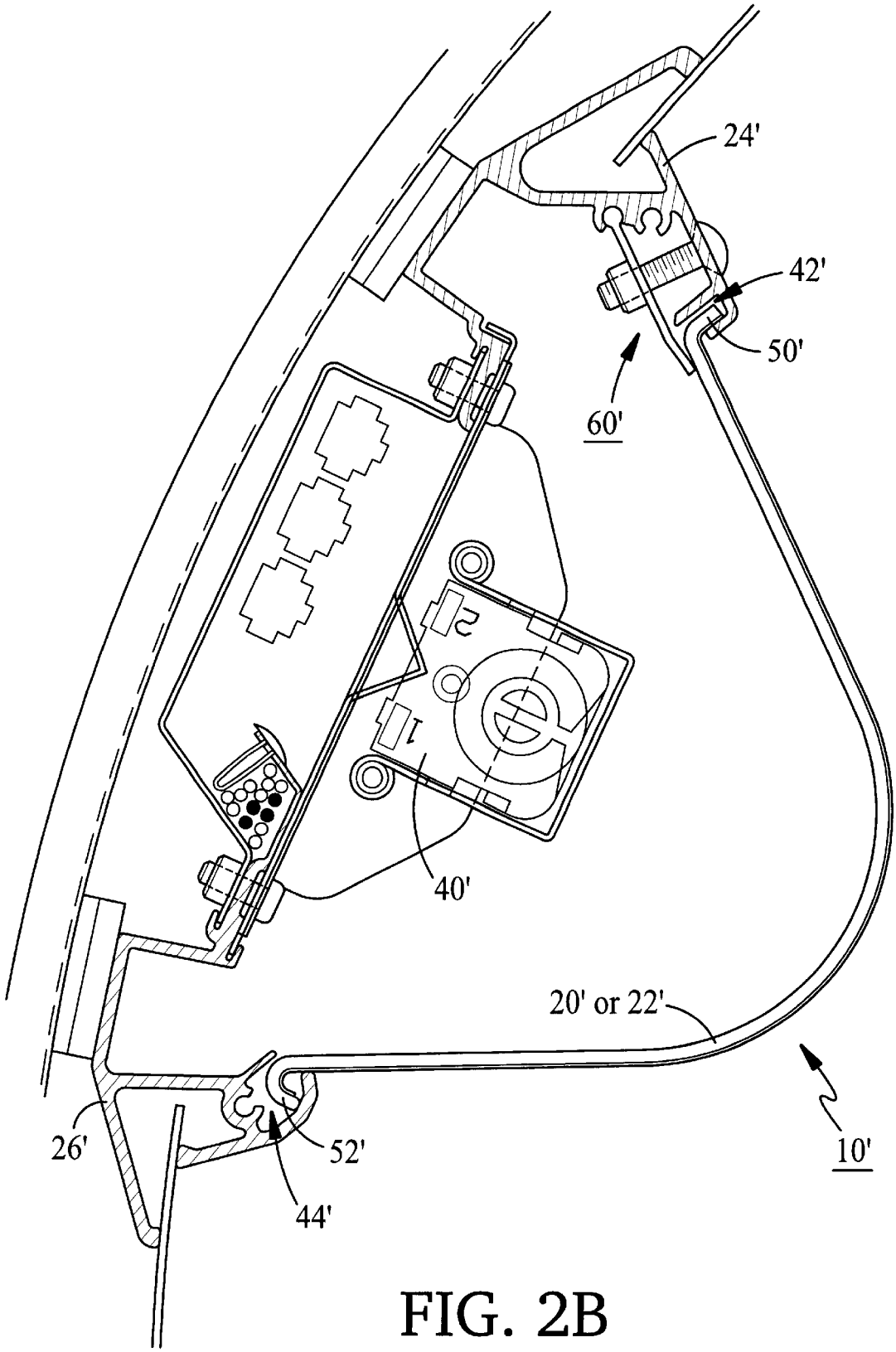
FIG. 2B is an end elevational view, partially in cross-section, of the lighting fixture, showing another embodiment of the lens retainer of the present invention.

FIGS. 2A and 2B illustrate the internal components of lighting fixtures 10 (FIG. 2A) and 10' (FIG. 2B). elements of lighting fixture 10' having the same or similar function as the elements of lighting fixture 1C are given primed reference numerals. Lighting fixtures 10 and 10' include conventional light producing means 40 and 40', horizontally extending upper mounting grooves 42 and 42' formed in upper extrusions 24 and 24', and horizontally extending lower mounting grooves 44 and 44 formed in lower extrusions 26 and 26'. As can be seen on FIGS. 2A and 2B, mounting flanges 50, 50', 52, and 52' formed, respectively along the upper and lower edges of lenses 20 and 20' have been snapped into, respectively, upper and lower mounting grooves 42, 42', 44, and 44' by the temporary plastic deformation of the lens. The elements described so far with reference to FIGS. 2A and 2B, or similar elements, are conventional. It will be understood, as described above, that a jolt to lighting fixtures 10 or 10' could cause the dislodgement of lenses 20 and 20' and that the lens could pose a danger to persons or property.

Also shown on FIGS. 2A and 2B are lighting fixture lens retainers, indicated generally by the reference numeral 60 and 60', the construction and use of which is described below. FIG. 2A represents an embodiment of the present invention where no screws are allowed to be exposed to the passengers. FIG. 2B represents an embodiment of the present invention having the same requirements as the embodiment on FIG. 2A, except that screws are allowed to be seen but not in the lens.

It will be understood that one of flanges 50' and 52' may be hingedly connected to lighting fixture 10' in a conventional manner.

Figure 3A:
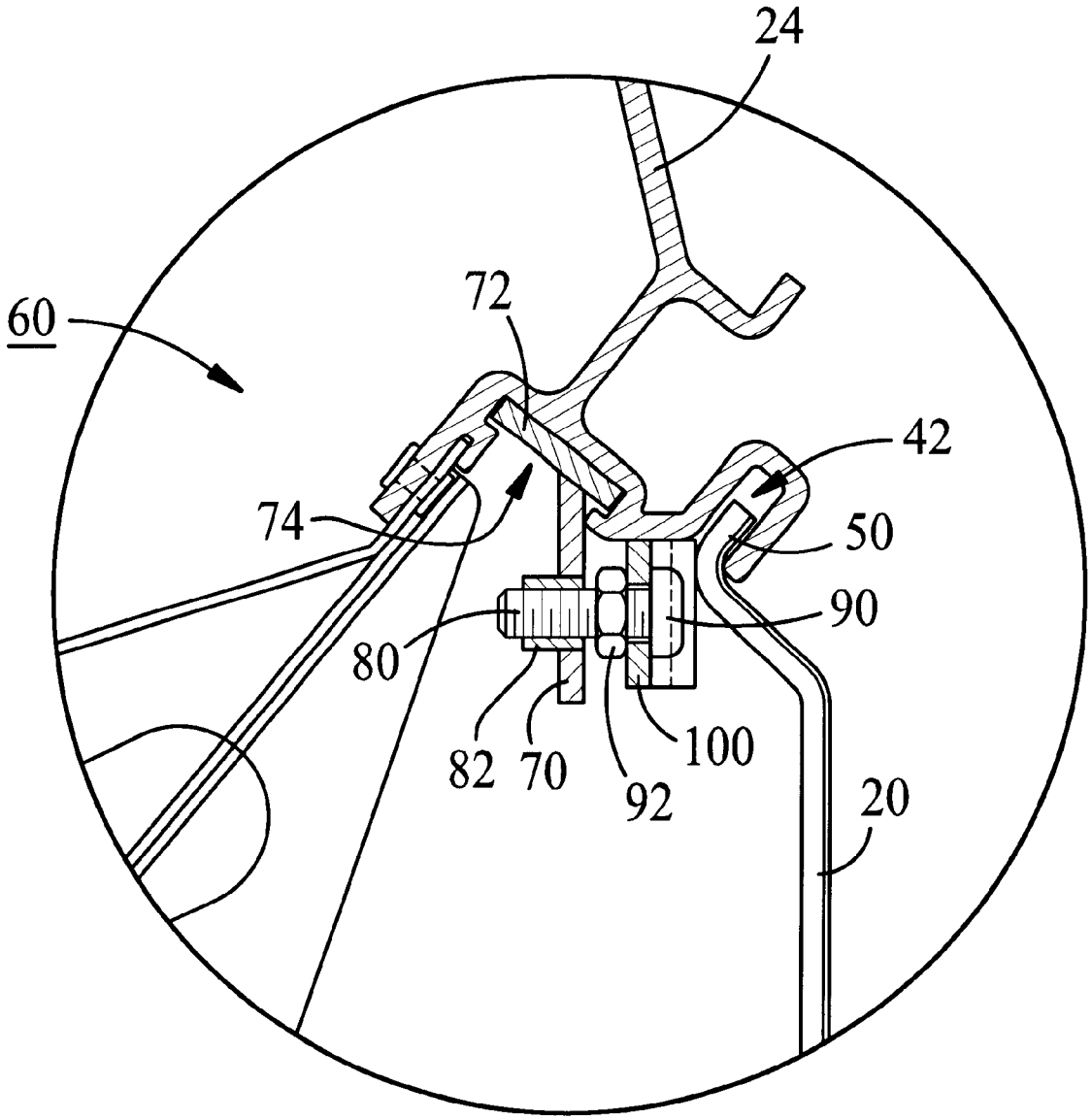
FIG. 3A is a fragmentary, end elevational view of the Lighting fixture with the lens retainer of FIG. 2A.

Referring now to FIG. 3A, lens retainer 60 includes a vertical member 70 having integrally formed at the upper end thereof an obliquely extending flange 72 fixedly disposed in slide groove 74, the latter element being formed in and extending along upper extrusion 24. A partially threaded screw 80 extends through vertical member 70 and into a threaded boss 82 extending from the rear surface of and fixedly disposed in the vertical member. Screw 80 has a head portion 90 and a jam nut 92 that is jammed against the right end of the threaded portion of the screw. A generally U-shaped member 100 is rotatingly disposed on a non-threaded portion of screw 80 adjacent head portion 90 and bears against mounting flange 50 of lens 20, thus securing the mounting flange in place and, likewise, securing the lens in place on lighting fixture 10 (FIG. 2A).

Figure 3B:
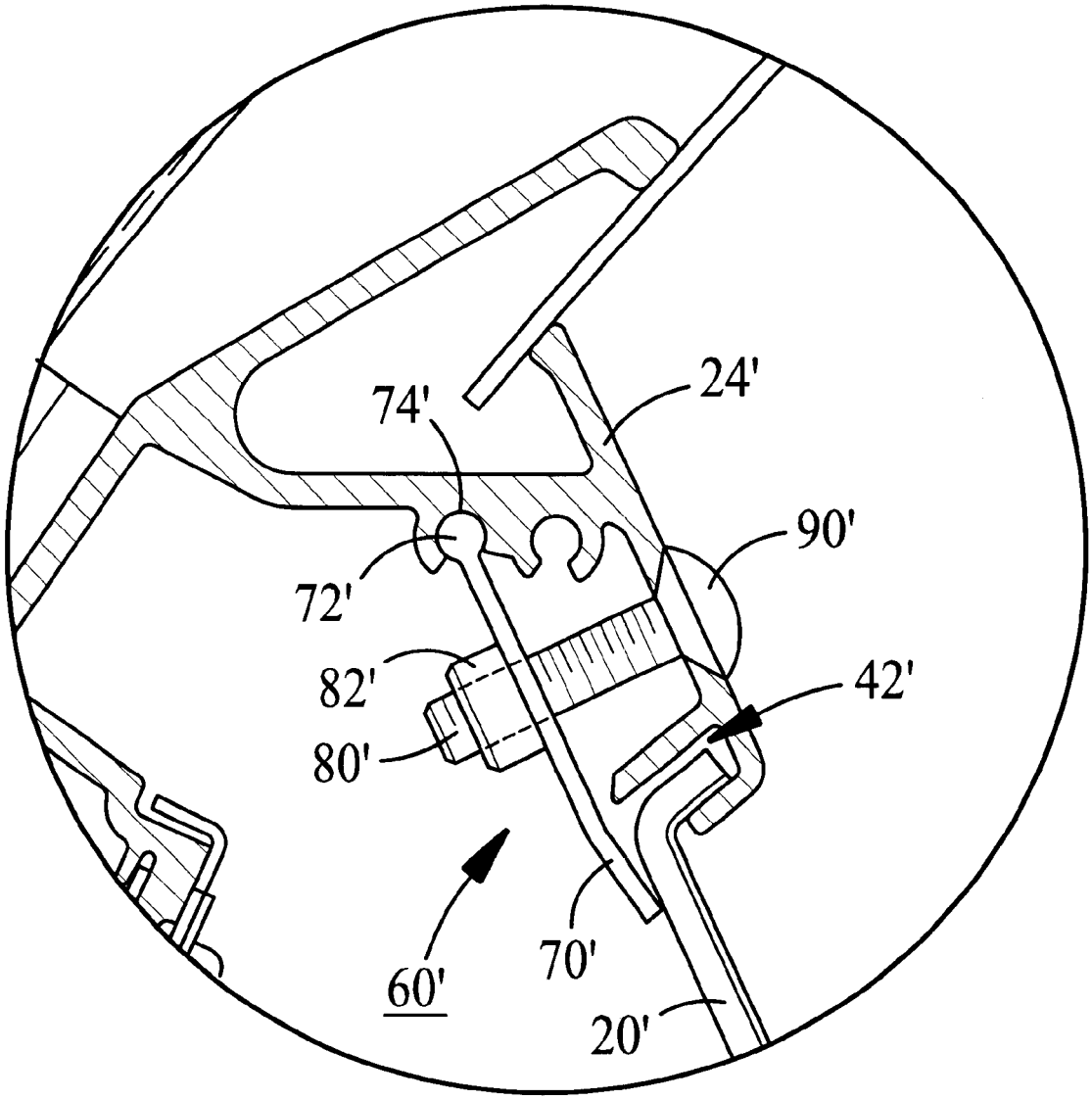
FIG. 3B is a fragmentary, end elevational view of the lighting fixture with the lens retainer of FIG. 2A.

Referring now to FIG. 3B, on which elements similar to the elements on FIG. 3A are given primed reference numerals, lens retainer 60' includes a generally vertical member 70' having integrally formed at the upper end thereof a bead flange 72' fixedly disposed in slide groove 74', the latter element being formed in and extending along upper extrusion 24'. A partially threaded screw 80' extends through generally vertical member 70' and into a threaded boss 82' extending from the rear surface of and fixedly disposed in the generally vertical member. Screw 80' has a head portion 90' that is jammed against the outer face of extrusion 24' FIG. 3B also illustrates lens retainer 60, securing lens 20' in place. It can be seen that generally vertical member 70' engages the inner surface of lens 20 to hold the lens in place in mounting groove 42'.

Figure 4C:
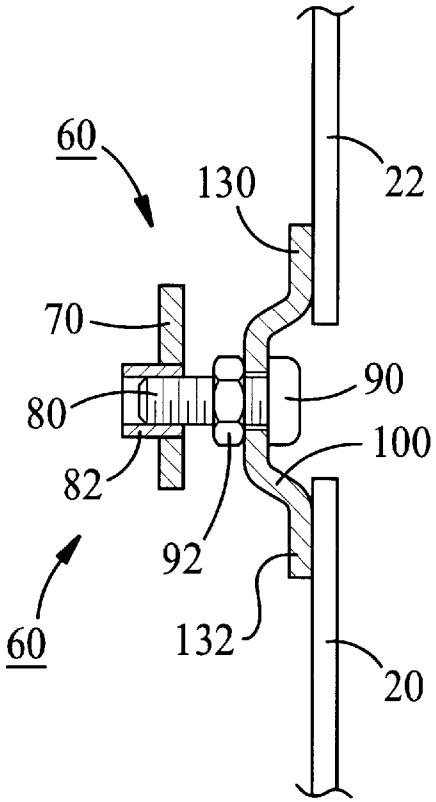
FIG. 4C is a fragmentary top plan view of the lighting fixture lens retainer of FIGS. 4A and 4B showing in use in securing two lenses in place.
Figure 4B:
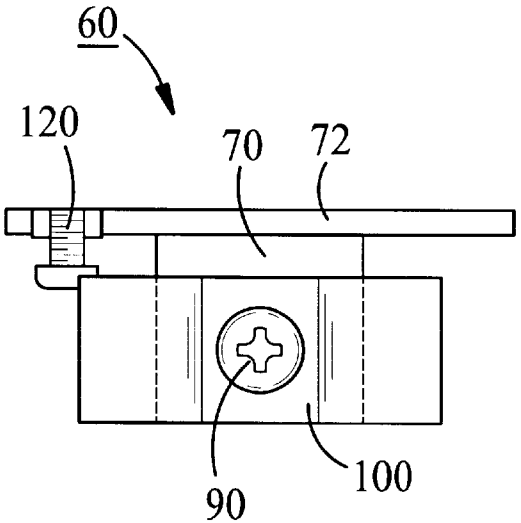
FIGS. 4A and 4B are side elevational and front elevational views, respectively, of a lighting fixture lens retainer similar to that of FIG. 3A.
Figure 4A:
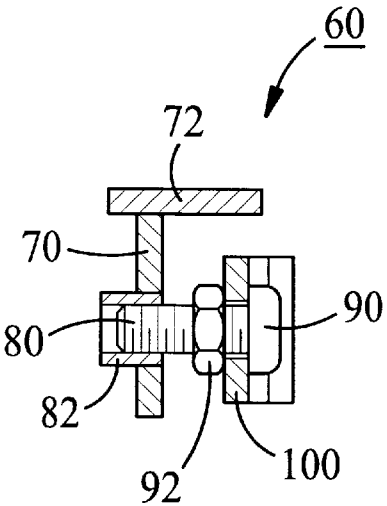

FIGS. 4A, 4B and 4C further illustrate the construction of lens retainer 60, the lens retainer shown here having a slightly different configuration, but the lens retainer and the elements thereof continuing to use the same reference numerals as above. FIG. 4C also illustrates lens retainer 60 securing lenses 20 and 22 in place.

Referring first to FIGS. 4A and 4B, the elements of lens retainer 60 described previously are shown. Additionally, FIG. 4B shows a set screw 120 that is used to fixedly position lens retainer 60 at a selected location along slide groove 74 (FIG. 3).

Referring now to FIG. 4C, it can be seen that first and second arms 130 and 132, respectively, of generally U-shaped member 100 engage inner surfaces of lenses 20 and 22 to hold the lenses in place in mounting groove 42 (FIG. 3). Force for the engagement is provided by a combination of jam nut 92 bearing against the rear surface of generally U-shaped member 100 and the threaded engagement of screw 80 and threaded boss 82. After first and second arms 130 and 132 of generally U-shaped member 100 are tightened against the inner surfaces of lenses 20 and 22, a penetrating adhesive is applied between screw 90, jam nut 92, and the generally U-shaped member to secure those elements in place.

Figure 5B:
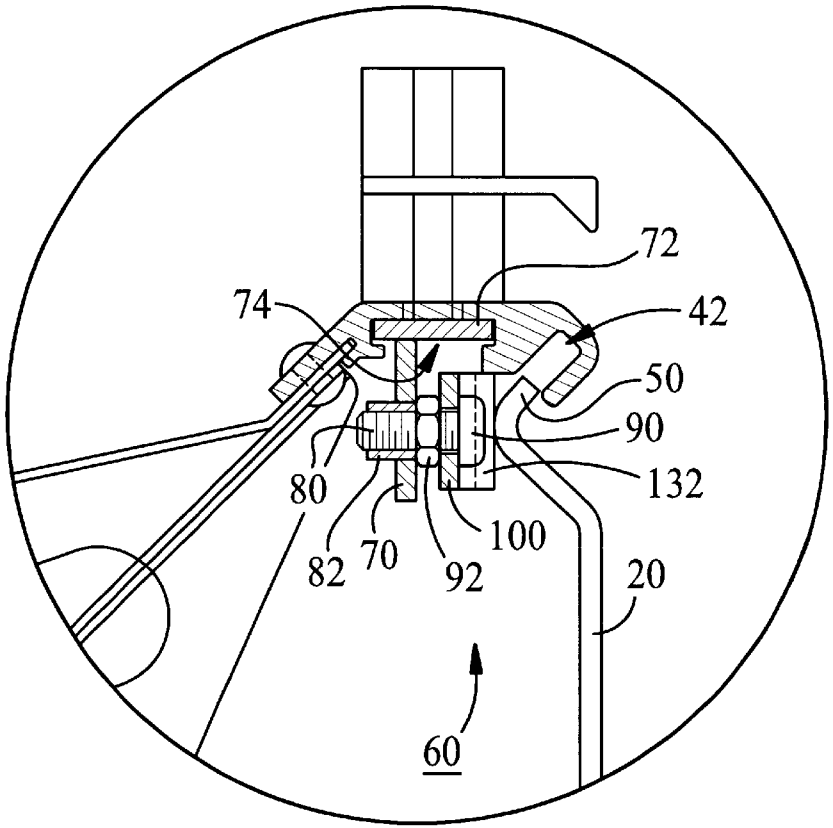
FIGS. 5A and 5B are side elevational views, partially in cross-section, of a further embodiment of the present invention, showing the use of the lighting fixture Lens retainer.
Figure 5A:
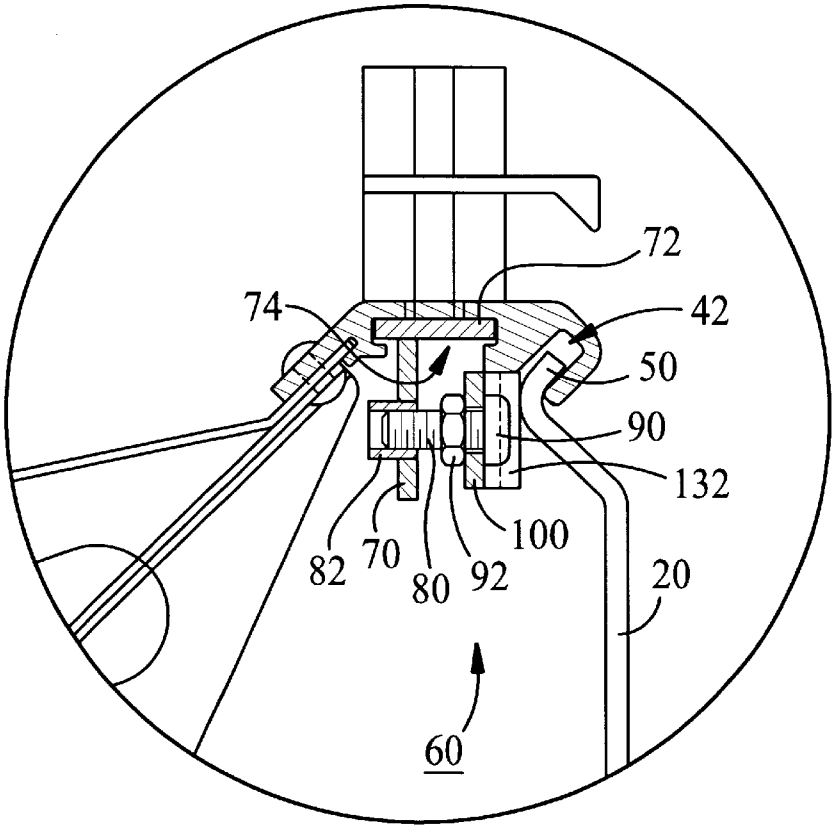

FIGS. 5A and 5B illustrate the use of lens retainer 60, with FIG. 5A illustrating the lens retainer in a first, retaining position holding mounting flange 50 of lens 20 in mounting groove 42 and with FIG. 5B illustrating the lens retainer In second, open position, with the lens retained spaced from lens 20, in which the lens may be removed from lighting fixture 10 (FIG. 1) by plastic deformation.

Referring first to FIG. 5A, lens retainer 60 has been brought to the position shown by inserting a screwdriver (not shown) into the gap defined between lenses 20 and 22 (FIG. 4C) with metal strip 30 (FIG. 1) removed, engaging head portion 90 (FIG. 4B) with the screwdriver and rotating screw 80 counterclockwise (assuming the screw has a right-hand thread). Sufficient such rotation causes arm 132 to engage the inner surface of lens 20 and hold mounting flange 50 of lens 20 securely in place in mounting groove 42.

Referring now to FIG. 5B, the same process has generally taken place, except that. screw 80 has been rotated clockwise such that arm 132 of generally U-shaped member 100 is drawn away from lens 20. Now, by temporary plastic deformation of lens 20, mounting flange 50 can be withdrawn from mounting groove 42 and the lens removed from lighting fixture to (FIG. 2).

It will be understood that lens retainer 60' is used in a manner similar to lens retainer 60 shown on FIGS. 4A, 4B, 4C, 5A, and 5B to hold lenses 20' and 22' in place in lighting fixture 10'.

Figure 6C:
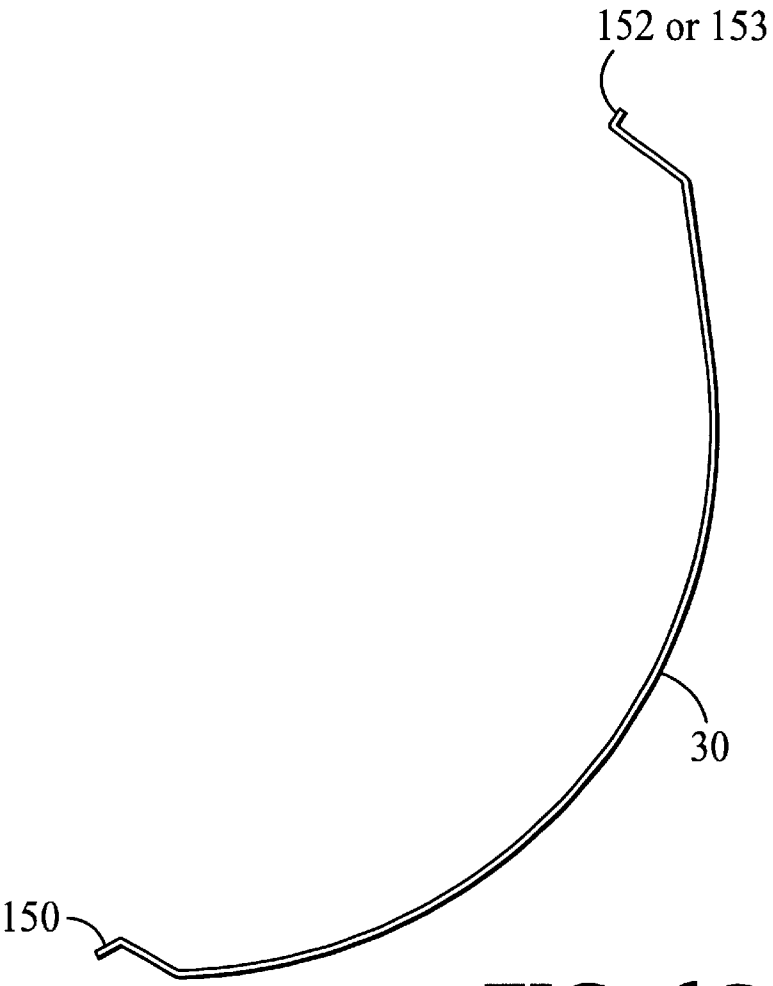
FIG. 6C is a side elevational view of a trim band for the lenses with the embodiment of FIG. 2A.
Figure 6B:
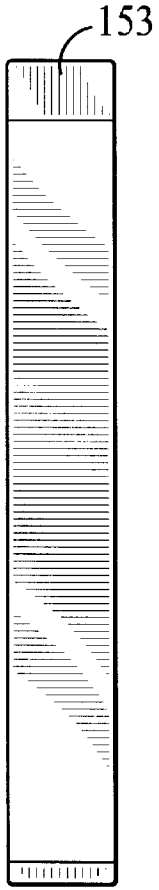
FIG. 6B is a front elevational view of a trim band for the embodiment of FIG. 2B.
Figure 6A:
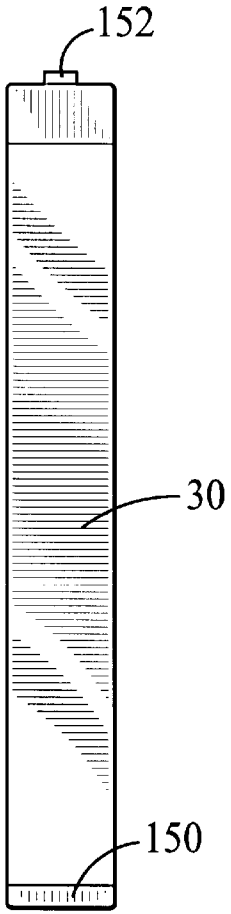
FIG. 6A is a front elevational view of a trim band for the embodiment of FIG. 2A.

FIGS. 6A, 6B, and 6C illustrate in more detail band 30 (FIG. 1) and show a mounting flange 150 formed at the lower end of the band and a mounting tab 152 (FIG. 6A) or mounting tab 153 (FIG. 6B) formed at the upper end of the band. For the type of installation under consideration, band 30 may be formed from suitably thin stainless steel and may be about 1-inch wide by about 8 inches high when installed.

Mounting tab 152 is about 0.30-inch wide, while mounting tab 153 is about one-inch wide. FIG. 6C illustrates the shape of band 30 when installed in lighting fixture 10 (FIG. 1), without any of the other components of the lighting fixture being illustrated. Mounting tab 153 is employed with the embodiment of the present invention shown on FIG. 23.

Conventionally, mounting tabs 152 and 153 would have the essentially the same shape as mounting flange 150 and band 30 would be installed as described above. With the present invention, mounting flange 150 is installed in the conventional manner, as is flange 153 for the embodiment of FIG. 2; however, for the embodiment shown on FIG. 2A, since lighting fixture retainer 60 (FIG. 5A) bears against the inner surfaces of lenses 20 and 22, the upper edges of the ends of the lenses cannot be pressed inwardly to create a gap into which the upper end of band 30 can be inserted. The present invention provides relatively narrow mounting tab 152 for the embodiment of FIG. 2A, so that the mounting tab can be inserted into the space created by the generally U-shaped member 100 and against the inner surface of the extrusion forming mounting groove 42. Following insertion of mounting tab 152, mounting flange 150 is inserted. The result is that lenses 20 and 22 and band 30 are securely held in place, with no screws or other fastening means showing.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spacially orienting terms such as "upper", "flower", "inner", "outer", "inwardly", "southwardly", "horizontal", "Vertical", and the like, when used herein, refer to the positions of the respective elements shown on the accompanying drawing figures and the elements of the present invention are not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A lighting fixture lens retainer for a lighting fixture of the type having a generally horizontally extending first lens held in upper and lower fixture members by insertion of first and second mounting flanges formed, respectively, along upper and lower edges of said first lens inserted into first and second mounting grooves formed, respectively, along said upper and lower fixture members, said lighting fixture lens retainer comprising: a retaining member being disposed within said lighting fixture and being movable between a first, open position in which said retaining member is spaced apart from an inner surface of said first lens and a second, securing position in which said retaining member bears against said inner surface of said first lens in such manner as to secure said first mounting flange in said first amounting groove.

2. A lighting fixture lens retainer, as defined in claim 1, wherein:

(a) said lighting fixture has a second lens extending coaxially with said first lens and attached to said lighting fixture in a manner similar to attachment of said first lens; and (b) said retaining member bears against an inner surface of said second lens to secure said second lens to said lighting fixture in a manner similar to securement of said first lens.

3. A lighting fixture lens retainer, as defined in claim 2, wherein: said retaining member is accessed for movement between said first and second positions through a gap defined between ends of said first and second lenses.

4. A lighting fixture lens retainer, as defined in claim 1, wherein:

a) said retaining member has a fixed portion fixedly attached to said upper lighting fixture member; and (b) said retaining member has a movable portion threadedly engaging said fixed portion and moveable between said first and second positions by means of rotating said movable portion to change its position with respect to said fixed portion.

5. A lighting fixture lens retainer as defined in claim 4, wherein: said fixed portion includes a flange portion inserted in a slide groove defined in said upper fixture member and fixed at a predetermined position in said slide groove.

6. A lighting fixture lens retainer, as defined in claim 4, wherein said movable portion comprises:

(a) a partially threaded screw threadedly engaging said fixed portion at a distal end of a threaded portion of said partially threaded screw;

(b) a jam nut jammed against a proximal end of said threaded portion;

(c) a generally U-shaped member rotatingly disposed on a non-threaded portion of said partially threaded screw, said non-threaded portion of said partially threaded screw being adjacent said proximal end;

(d) a screw head disposed adjacent said generally U-shaped member;

(e) said threaded portion, said non-threaded portion, and said screw head being co-axially aligned; and (f) said generally U-shaped member having first and second arms that engage, respectively, said inner surfaces of said first and second lenses.

7. A lighting fixture lens retainer, as defined in claim 1, wherein:

(a) said lens retainer includes a generally vertical member rotatingly attached to said upper fixture member at a proximal end of said generally vertical member;

(b) a partially threaded screw extending through a medial portion of said generally vertical member and having its head external to an outer surface of said upper fixture member; and (c) a threaded boss fixedly attached to a rear surface of said generally vertical member, through which threaded boss said partially threaded screw threadedly extends;

whereby: selective rotation of said partially threaded screw causes a distal end of said generally vertical member to move between said open position and said securing position.

8. A trim band for a lighting fixture having a generally horizontally extending first lens held in upper and lower fixture members by insertion of first and second mounting flanges formed, respectively, along upper and lower edges of said first lens inserted into first and second mounting grooves formed, respectively, along said upper and lower fixture members, said lighting fixture lens retainer including a retaining member being disposed within said lighting fixture and being movable between a first, open position in which said retaining member is spaced apart from an inner surface of said first lens and a second, securing position in which said retaining member bears against said inner surface of said first lens in such manner as to secure said first mounting flange in said first mounting groove and said lighting fixture further having a second lens extending coaxially with said first lens and attached to said lighting fixture in a manner similar to attachment of said first lens; and said retaining member bears against an inner surface of said second lens to secure said second lens to said lighting fixture in a manner similar to securement of said first lens, said trim band is relatively long and narrow and comprises:

(a) a mounting flange formed at a lower end thereof and a mounting tab formed at an upper end thereof;

(b) said mounting tab being insertable into a space defined by said lighting fixture lens retainer and into said first mounting groove; and (c) said mounting flange being insertable into said second mounting groove into a space formed by plastic deformation of said first and second lenses;

such that said trim band covers a joint formed between ends of said first and second lenses.

* * * * *